US006563403B2

(12) United States Patent
Kanba et al.

(10) Patent No.: US 6,563,403 B2
(45) **Date of Patent: *May 13, 2003**

(54) DUAL MODE BAND-PASS FILTER

(75) Inventors: Seiji Kanba, Kusatsu (JP); Naoki Mizoguchi, Shiga-ken (JP); Hisatake Okamura, Nagaokakyo (JP); Osamu Chikagawa, Moriyama (JP); Naoya Mori, Omihachiman (JP); Yasutaka Sugimoto, Kyoto (JP)

(73) Assignee: Murata Manufacturing Co., Ltd., Kyoto (JP)

( * ) Notice: Subject to any disclaimer, the term of this patent is extended or adjusted under 35 U.S.C. 154(b) by 0 days.

This patent is subject to a terminal disclaimer.

(21) Appl. No.: 09/867,250

(22) Filed: May 29, 2001

(65) Prior Publication Data

US 2002/0053960 A1 May 9, 2002

(30) Foreign Application Priority Data

May 29, 2000 (JP) ..... 2000-158658

(51) Int. Cl.[7] ..... H01P 1/203
(52) U.S. Cl. ..... 333/204; 333/219
(58) Field of Search ..... 333/204, 205, 333/219; 501/32

(56) References Cited

U.S. PATENT DOCUMENTS 5,136,268 A * 8/1992 Fiedziuszko et al. ..... 333/204
5,172,084 A * 12/1992 Fiedziuszko et al. ..... 333/204
5,756,412 A * 5/1998 Lee et al. ..... 501/135
5,939,958 A * 8/1999 Grounds et al. ..... 333/204
6,051,515 A * 4/2000 Hiramatsu ..... 501/135
6,108,192 A * 8/2000 Sugimoto et al. ..... 501/134
6,207,905 B1 * 3/2001 Taga et al. ..... 501/32
6,258,462 B1 * 7/2001 Kagata et al. ..... 428/432
6,348,424 B1 * 2/2002 Hazeyama et al. ..... 501/32
6,403,199 B2 * 6/2002 Mori et al. ..... 428/209

FOREIGN PATENT DOCUMENTS

| | | |
|---|---|---|
| JP | 06/112701 | 4/1994 |
| JP | 09-139612 | 5/1997 |
| JP | 09-162610 | 6/1997 |

* cited by examiner

*Primary Examiner*—Seungsook Ham
(74) *Attorney, Agent, or Firm*—Keating & Bennett, LLP

(57) ABSTRACT

A dual mode band-pass filter includes a dielectric body having first and second main surfaces, a metal film partially disposed on the first main surface of the dielectric body or at a predetermined level in the dielectric body, the metal film having any one of an opening, a protrusion, and a cut-out arranged to combine two resonant modes, at least one ground electrode disposed on the second main surface or in the interior of the dielectric body so as to be opposed to the metal film with a portion of the dielectric body being disposed therebetween, and a pair of input-output coupling circuits that are coupled with different portions of the metal film. The dielectric body includes a dielectric ceramic containing a ceramic and a glass as main constituents, capable of being fired simultaneously with Cu, Ag, or Au, and having a Q value of more than approximately 300 at about 10 GHz.

25 Claims, 6 Drawing Sheets

DUAL MODE BAND-PASS FILTER

BACKGROUND OF THE INVENTION

1. Field of the Invention

The present invention relates to a dual mode band-pass filter used, for example, as a band filter in a communication apparatus operating in a band that ranges from the microwave band to the millimeter wave band. In particular, the present invention relates to a dual mode band-pass filter having an improved dielectric body.

2. Description of the Related Art

As band-pass filters used in the high-frequency range, various types of dual mode band-pass filters have been ARE known (e.g., refer to MINIATURE DUAL MODE MICROSTRIP FILTERS, J. A. Curtis and S. J. Fiedziuszko, 1991 IEEE MTT-S Digest).

FIGS. 5 and 6 are schematic diagrams showing conventional dual mode band-pass filters.

In a band-pass filter 200 shown in FIG. 5, a circular conductive film 201 is provided on a dielectric body (not shown in the drawing). An input-output coupling circuit 202 and an input-output coupling circuit 203 are coupled with the conductive film 201 and are arranged to be perpendicular to each other. An open-top stub 204 is arranged to be at a central angle of 45° with respect to the input-output coupling circuit 203. As a result, two resonant modes having different resonant frequencies are combined so that the band-pass filter 200 functions as a dual mode band-pass filter.

In a dual mode band-pass filter 210 shown in FIG. 6, a substantially square conductive film 211 is provided on a dielectric body. Input-output coupling circuits 212 and 213 are coupled with the conductive film 211 and are arranged to be perpendicular to each other. One corner, which is positioned at an angle of 135° with respect to the input-output coupling circuit 213, is chamfered. As a result of a chamfered section 211*a* being provided, two resonant modes have different resonant frequencies, and the two resonant modes are combined so that the band-pass filter 210 functions as a dual mode band-pass filter.

On the other hand, dual mode filters using ring-shaped conductive films instead of circular conductive films are also known, as disclosed in Japanese Unexamined Patent Application Publication Nos. 9-139612 and 9-162610. That is, in such a dual mode filter, a ring transmission line is used, and in a manner similar to that in the dual mode band-pass filter shown in FIG. 5, input-output coupling circuits are arranged to be perpendicular to each other, and also an open-top stub is provided on a portion of the ring transmission line.

Japanese Unexamined Patent Application Publication No. 6-112701 also discloses a dual mode filter using a similar ring transmission line.

In the various types of conventional dual mode band-pass filters described above, as the dielectric body, for example, a BaO—$Al_2O_3$—$SiO_2$ type ceramic body containing BaO, $Al_2O_3$, and $SiO_2$ as main constituents, or a body composed of a synthetic resin is used.

In the conventional dual mode band-pass filter, by forming one conductive film pattern, a double band-pass filter can be constructed, and thus the band-pass filter can be miniaturized.

However, in the conductive pattern having a particular shape, since input-output coupling circuits must be spaced at a predetermined angle, it is not possible to increase the degree of coupling, and a broader pass band cannot be achieved.

Additionally, since the shape of the conductive film is limited, design versatility is low.

Moreover, in the conventional dual mode band-pass filter, since the frequency band used is up to several GHz at most, the dielectric loss of the dielectric body, i.e., the Q value of the dielectric, need not be taken into account.

In general, the Q value of a dielectric decreases as the frequency decreases. That is, as the frequency increases, the dielectric loss increases. For example, a dielectric body made of the BAS material has a Q value of approximately 300 at 10 GHz, and the dielectric loss is greatly increased at the frequency band of 10 GHz or more.

Therefore, in conventional band-pass filters, the insertion loss is high in the high-frequency range.

SUMMARY OF THE INVENTION

In order to overcome the problems described above, preferred embodiments of the present invention provide a dual mode band-pass filter that is miniaturized, has greatly increased design versatility, and a greatly reduced insertion loss at the high-frequency range.

In accordance with a preferred embodiment of the present invention, a dual mode band-pass filter includes a dielectric body having first and second main surfaces, a metal film partially provided on the first main surface of the dielectric body or at a predetermined level in the dielectric body, the metal film being provided with an opening, a protrusion, or a cut-out arranged to combine two resonant modes, at least one ground electrode disposed on the second main surface or in the interior of the dielectric body so as to be opposed to the metal film with a portion of the dielectric body therebetween, and a pair of input-output coupling circuits being coupled with different portions of the metal film. The dielectric body is preferably made of a dielectric ceramic containing a ceramic and a glass as main constituents, is capable of being fired simultaneously with any one of Cu, Ag, and Au, and has a Q value of more than approximately 300 at about 10 GHz.

Consequently, since the shape of the metal film is not particularly limited, it is possible to increase design versatility, and it is also possible to easily provide dual mode band-pass filters having various bandwidths. When the metal film and the ground electrodes are made of Cu, Ag, or Au, the dielectric body can be fired simultaneously with the metal film and the ground electrodes, and it is possible to produce a band-pass filter efficiently using a known integrated ceramic firing technique. Furthermore, since the Q value is more than approximately 300 at about 10 GHz, it is possible to construct a dual mode band-pass filter in which the insertion loss is small.

Preferably, in the dual mode band-pass filter, the dielectric body includes (A) MgO—$MgAl_2O_4$-based ceramic powder and (B) glass powder containing about 13% to about 50% by weight $SiO_2$, about 3% to about 60% by weight $B_2O_3$, and about 0% to about 20% by weight $Al_2O_3$.

When the dielectric ceramic containing the MgO—$MgAl_2O_4$-based ceramic powder and the glass powder having the predetermined composition as described above is used, the Q value is approximately 400 or more at about 10 GHz, and thus it is possible to further decrease the insertion loss.

More preferably, the glass powder contains at least one alkaline-earth metal oxide selected from the group consisting of BaO, SrO, CaO, and MgO in an amount of about 10% to about 40% by weight of the total glass powder.

The alkaline-earth metal described above decreases the melting temperature during the formation of glass and also acts as a crystal constituent in crystallized glass. If the content of the alkaline-earth metal oxide is less than about 10% by weight, the melting temperature may be increased. If the content exceeds about 40% by weight, the amount of crystal precipitation increases and the strength of the body may be decreased.

Since it is possible to decrease the melting temperature during the formation of glass, the firing cost of the dielectric body is greatly reduced.

Preferably, the glass powder preferably contains at least one alkali metal oxide selected from the group consisting of $Li_2O$, $K_2O$, and $Na_2O$ in an amount of about 10% by weight or less of the total glass powder, and more preferably, in an amount of about 2% to about 5% by weight. The alkali metal oxide decreases the melting temperature during the formation of glass. Consequently, the cost of formulating glass powder can be reduced and also it is possible to prevent the Q value from decreasing. If the content of the alkali metal oxide exceeds approximately 10% by weight, the Q value may be decreased.

Preferably, the dielectric body contains about 15% by weight or less ZnO, and more preferably, about 10% by weight or less. The zinc oxides decrease the firing temperature. Due to the zinc oxides contained, a dense dielectric body can be obtained. If the content of the zinc oxides as ZnO exceeds about 15% by weight, it may not be possible to obtain a dense sintered compact.

Additionally, the zinc oxides may be provided as glass components.

Preferably, the dielectric body contains about 3% by weight or less CuO, more preferably, about 2% by weight or less. The copper oxides decrease the firing temperature. Due to the copper oxides being provided, a dielectric body having a high Q value can be obtained. If the content of the copper oxides exceeds about 3% by weight, the Q value may be decreased.

Preferably, the MgO—$MgAl_2O_4$-based ceramic powder is represented by the formula $xMgO\text{-}yMgAl_2O_4$, where x and y satisfy the relationships $10 \leqq x \leqq 90$ and $10 \leqq y \leqq 90$, respectively, and $x+y=100$. Consequently, it is possible to obtain a dense sintered compact by firing at low temperatures, and even when firing is performed at low temperatures, it is possible to decrease the amount of the glass power to be used, and also a dielectric body having a low dielectric constant and a high Q value in the high-frequency band can be reliably obtained. If x, which represents the weight percentage of MgO, exceeds about 90, the humidity resistance of MgO may be degraded. If x is less than about 10, the content of the expensive glass to be added may be increased in order to carry out firing at 1,000° C. or less.

Preferably, the weight ratio of the ceramic powder to the glass powder is approximately 20:80 to 80:20, and more preferably, approximately 40:60 to approximately 60:40. Consequently, it is possible to obtain a denser dielectric body, and it is possible to prevent the Q value from decreasing by the use of the glass powder. If the ratio of the ceramic powder exceeds the above range, the density of the sintered compact may be decreased, and if the ratio of the glass powder exceeds the above range, the Q value may be decreased.

Other features, elements, characteristics and advantages of the present invention will become more apparent from the following detailed description of preferred embodiments with reference to the attached drawings.

DETAILED DESCRIPTION OF THE PREFERRED EMBODIMENTS

Preferred embodiments of the present invention will be described with reference to the drawings.

Figure 1A:
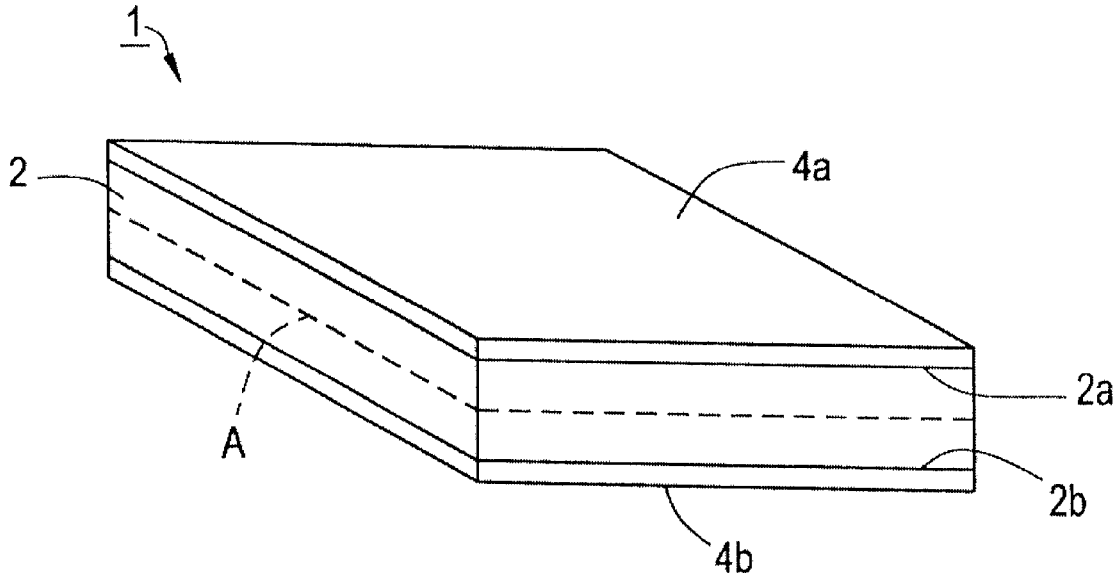
FIGS. 1A and 1B are perspective views of a dual mode band-pass filter according to a first preferred embodiment of the present invention, showing the appearance and the internal structure, respectively.
Figure 1B:
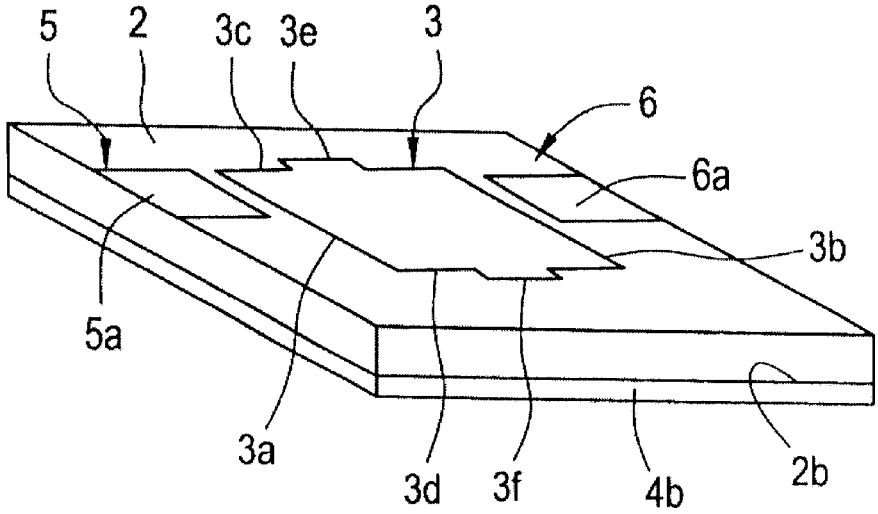
Figure 1C:
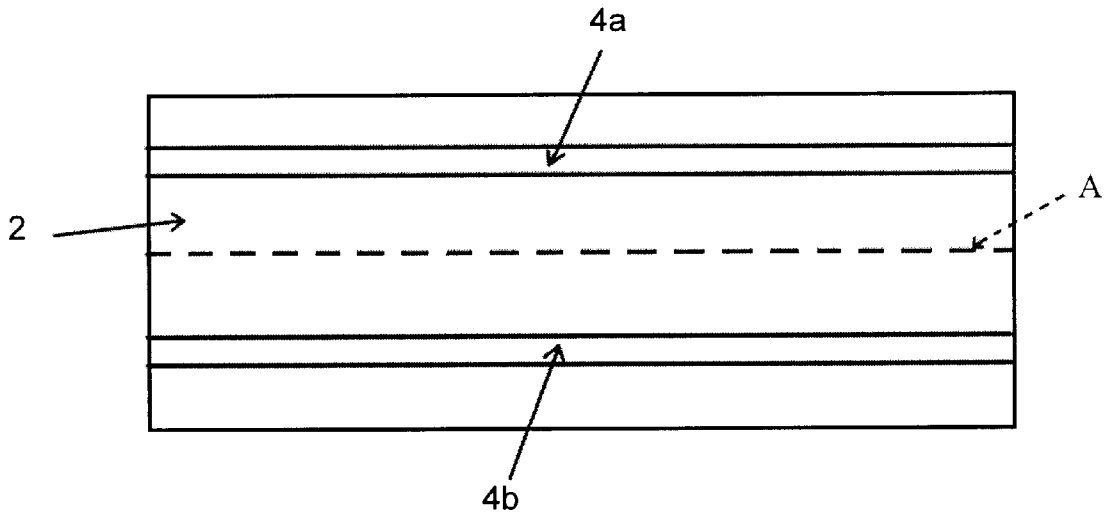
FIG. 1C is a cross sectional view showing another preferred embodiment of a dual mode band-pass filter.
Figure 2:
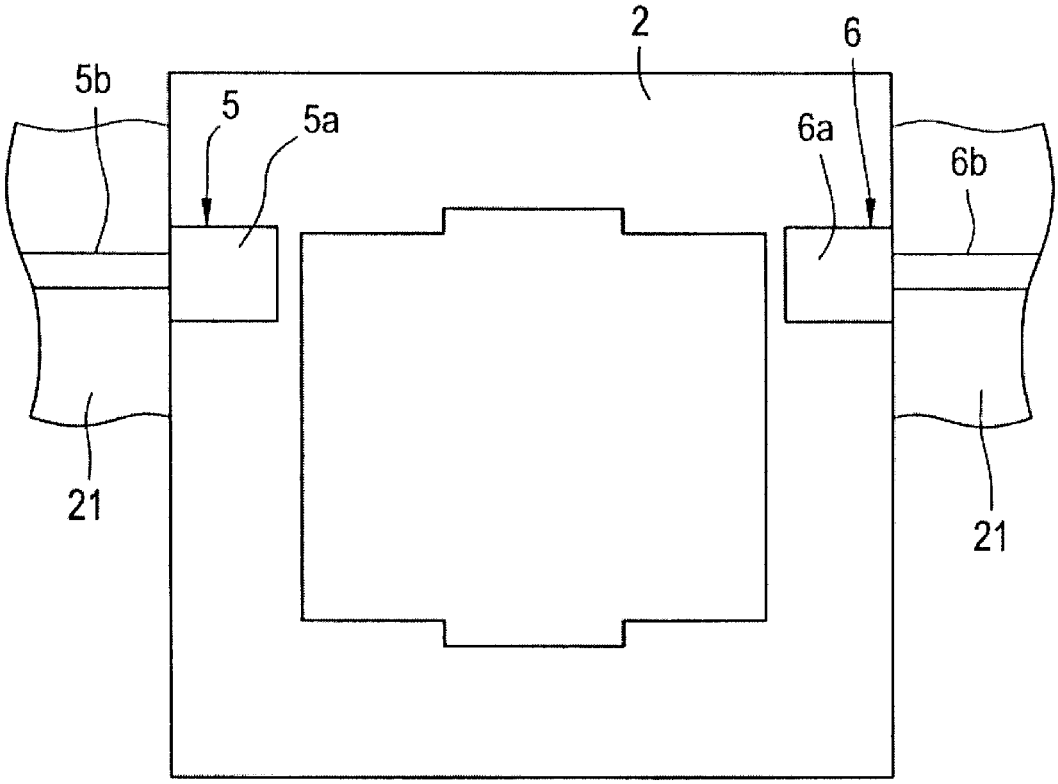
FIG. 2 is a schematic plan view of the dual mode band-pass filter according to the first preferred embodiment with which strip lines of input-output coupling circuits are coupled.

FIGS. 1A and 1B are perspective views of a dual mode band-pass filter according to a first preferred embodiment of the present invention, showing the appearance and the structure of a resonator provided within a dielectric body, respectively. FIG. 1C is a perspective view of a dual mode band-pass filter according to an alternate preferred embodiment of the present invention. FIG. 2 is a schematic plan view which shows the key portion of the band-pass filter.

A dual mode band-pass filter 1 includes a dielectric body 2 that preferably has a substantially rectangular plate. The dielectric body 2 is preferably made of a material containing a ceramic and a glass as main constituents, capable of being fired simultaneously with Cu, Ag, or Au, having a Q value of more than about 300 at approximately 10 GHz.

A substantially rectangular metal film 3 is preferably disposed in the dielectric body 2 at a predetermined level, as shown in FIG. 1B. The metal film 3 is provided to define a resonator. The level of the metal film 3 corresponds to the level indicated by a broken line A in FIG. 1A.

Protrusions 3*e* and 3*f* are disposed on longer sides 3*c* and 3*d* of the metal film 3, respectively. The protrusions 3*e* and 3*f* are arranged to combine two resonant modes occurring in the metal film 3 which will be described below.

Input-output coupling circuits 5 and 6 are arranged at the short sides 3*a* and 3*b* of the metal film 3, respectively, with gaps being provided therebetween. As shown in FIG. 1B, the input-output coupling circuits 5 and 6 include input-output capacitance-forming patterns 5*a* and 6*a* which are capacitively coupled with the metal film 3. As schematically shown in FIG. 2, the input-output capacitance-forming patterns 5*a* and 6*a* are connected to strip lines 5*b* and 6*b* as external lines through side electrodes disposed on the sides of the dielectric body 2 and via-hole electrodes disposed in the dielectric body 2. Additionally, the strip lines 5*b* and 6*b* are arranged on a dielectric mother body 21 which is separate from the dielectric body 2.

As shown in FIG. 1A, a ground electrode 4*a* is arranged substantially over the entire upper surface of the dielectric body 2, and a ground electrode 4*b* is arranged substantially over the entire lower surface of the dielectric body 2. That is, the ground electrodes 4*a* and 4*b* are opposed to each other with the metal film 3 and the dielectric body 2 therebetween.

As described above, the dual mode band-pass filter 1 preferably has a triplate structure in which the ground electrodes 4*a* and 4*b* are disposed on and under the metal film 3 with the dielectric body 2 therebetween.

In the dual mode band-pass filter according to preferred embodiments of the present invention, the metal film 3 and the input-output coupling circuits 5 and 6 may be disposed on the upper surface of the dielectric body 2. In such a case, the ground electrode 4*a* is not provided, and only the ground electrode 4*b* is provided. That is, the metal film 3 may be disposed either on an upper surface 2*a*, as the first main surface of the dielectric body 2, or in the dielectric body 2 at a predetermined level. The metal film 3 is partially formed at such a level on or in the dielectric body.

It is not always necessary to provide the ground electrodes 4*a* and 4*b* on the upper surface 2*a* and a lower surface 2*b*, as the first and second main surfaces, of the dielectric body 2, and the ground electrodes 4*a* and 4*b* may be provided in the dielectric body 2.

In the dual mode band-pass filter 1, when an input voltage is applied from the input-output coupling circuits 5 and 6, in the metal film 3, a resonant mode propagating in the direction of the longer sides 3*c* and 3*d*, i.e., in the direction connecting between coupling points of the input-output coupling circuits 5 and 6 with the metal film 3, and a resonant mode propagating in a direction that is substantially perpendicular to the above propagating direction, i.e., in the extending direction of the shorter sides 3*a* and 3*b*, occur. Although the two resonant modes have different resonant frequencies, the protrusions 3*e* and 3*f* are arranged so as to combine the two resonant modes. That is, by providing the protrusions 3*e* and 3*f*, a resonance electric field in the resonant mode propagating in the direction of the short sides is decreased, and the resonant frequency of the resonant mode propagating in the direction of the short sides is decreased, and thus the resonant mode is combined with the resonant mode propagating in the direction of long sides 3*c* and 3*d*. Consequently, characteristics of a dual mode band-pass filter can be obtained.

Additionally, in the dual mode band-pass filter 1, as described above, the characteristics as the dual mode band-pass filter are obtained by combining the two resonant modes occurring in the metal film 3, i.e., the resonant mode propagating in the direction connecting between the coupling points of the input-output coupling circuits 5 and 6 with the metal film 3 and the resonant mode propagating in the direction that is substantially to the above-described direction. Therefore, the shape of the metal film 3 is not limited to being substantially rectangular, and the metal film 3 of any given shape, such as a substantially rhombic metal film or a substantially elliptic metal film, may be used, thus increasing design versatility.

Alternatively, the metal film 3 may be isotropic in shape, and for example, a substantially circular or a substantially square metal film may be used. In such a case, although two resonant modes which propagate in directions which are substantially perpendicular to each other may have the same resonant frequency, even in this case, by forming the protrusions 3*e* and 3*f*, the resonant frequencies of the two resonant modes can be combined, and thus characteristics of a dual mode band-pass filter can be obtained.

The other feature of the dual mode band-pass filter 1 is that the dielectric body 2 is constructed using the predetermined dielectric ceramic described above. That is, the dielectric body 2 preferably includes a dielectric ceramic containing a ceramic and a glass as main constituents, and capable of being fired simultaneously with any one of Cu, Ag, and Au. Therefore, when the metal film 3 and the input-output capacitance-forming patterns 5*a* and 6*a* preferably include Cu, Ag, or Au, it is possible to efficiently and easily form the dielectric body 2 simultaneously with the metal film 3 and the input-output capacitance-forming patterns 5*a* and 6*a* by firing using a known integrated firing technique.

Furthermore, by constructing the ground electrodes 4*a* and 4*b* using Cu, Ag, or Au, it is possible to form the ground electrodes 4*a* and 4*b* by baking them simultaneously with the dielectric body 2.

Since the dielectric ceramic preferably has a Q value of more than approximately 300 at about 10 GHz, the dielectric loss occurring when used at a frequency band of about 10 GHz or more is low, and therefore, the insertion loss of the dual mode band-pass filter can be decreased.

This will be more specifically described.

Figure 3:
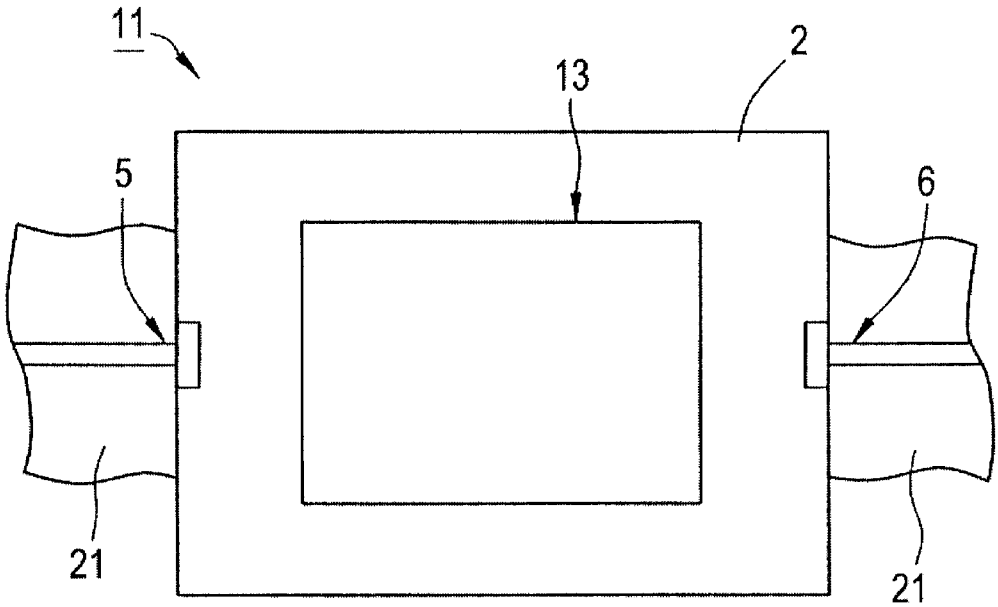
FIG. 3 is a schematic plan view of a resonator.

Assuming a resonator 11 including a metal film 13 which does not have protrusions, as shown in FIG. 3, in the resonator 11, only a resonant mode in the direction of longer sides of a dual mode band-pass filter can be selected. By evaluating the unloaded Q value of the resonator 11, the insertion loss (IL) of the dual mode band-pass filter is evaluated indirectly. The unloaded Q value of the resonator 11 is defined by the equations below.

$$\text{Loaded } Q = \text{Resonant Frequency/Bandwidth} \quad (1)$$

$$\text{Unloaded } Q = \text{Loaded } Q/(1-10^{-IL/20}) \quad (2)$$

In the above equations, the resonant frequency is a frequency of the resonant mode excited in the metal film 13, the bandwidth is a bandwidth of the resonant mode of the resonator 11 at the point in which the amount of attenuation is decreased from the peak value by about 3 dB, and the loaded Q value is a Q value determined by both the loss of the resonator (unloaded Q) and the loss of the external circuit. In the equation (2), −IL is the peak value of the resonant mode $S_{21}$. Therefore, by measuring the resonant frequency of the resonant mode of the resonator, the bandwidth, and the insertion loss (IL), the unloaded Q can be determined.

In an example, a resonator 11 was manufactured in which the dielectric body 2 included a dielectric ceramic having a relative dielectric constant of about 7.0 and a dielectric Q value of approximately 3,000 at about 10 GHz. For comparison, a resonator 11 was manufactured to include a conventional BAS body with a relative dielectric constant of 6.4 and a dielectric Q value of 300 was used. The resonators 11 in the example and the comparative example had the same structures and sizes with respect to the individual sections. The resonant frequency of the resonant mode occurring in the metal film 13 was approximately 30 GHz. When the BAS body was used, the unloaded Q value was 85, and when the dielectric ceramic was used, the unloaded Q value was 235.

Accordingly, it was established that by using the dielectric body 2 made of the predetermined dielectric ceramic instead of the BAS body, the unloaded Q value was increased by about three times.

In another example, a dual mode band-pass filter in accordance with preferred embodiments described above was manufactured in which protrusions 3*e* and 3*f* were provided so as to combine two resonant modes.

Figure 4:
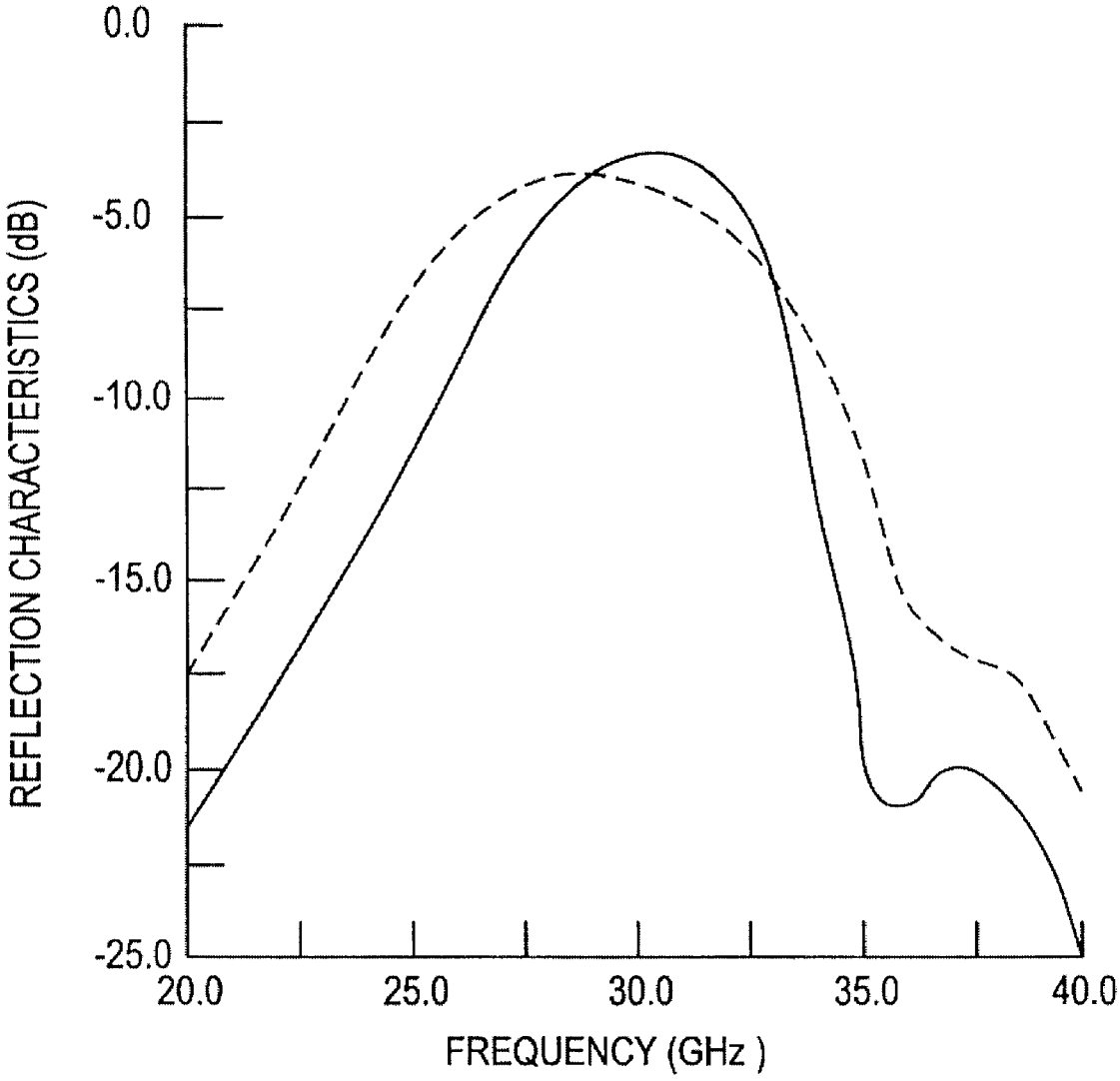
FIG. 4 is a graph showing the frequency characteristics of dual mode band-pass filters.
Figure 5:
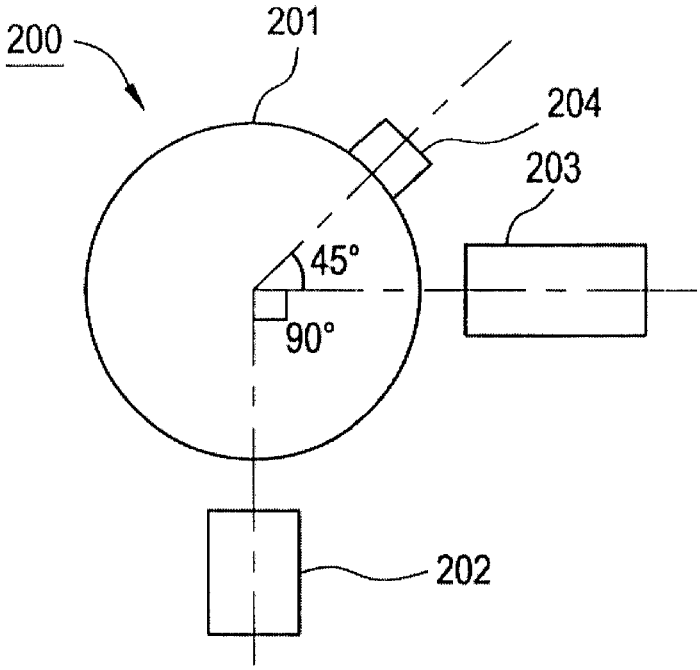
FIG.5 PRIOR ART
FIG. 5 is a schematic plan view showing a conventional dual mode band-pass filter.
Figure 6:
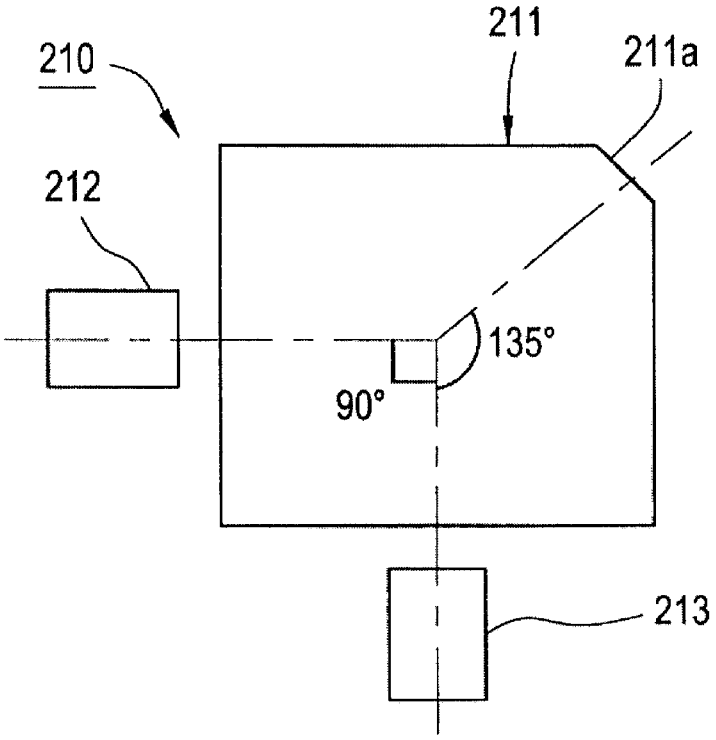
FIG.6 PRIOR ART
FIG. 6 is a schematic plan view showing another conventional dual mode band-pass filter.

FIG. 4 shows the frequency characteristics with respect to the dual mode band-pass filter in this example and, for comparison, a band-pass filter that was manufactured in the same manner as that of the example apart from the fact that the dielectric body was a BAS body. In FIG. 4, the solid line represents the results of the example and the broken line represents the results of the comparative example.

As is obvious from FIG. 4, in the dual mode band-pass filter in the example, the peak value of the resonant mode S21 is increased, and in terms of insertion loss, the band pass filter in the comparative example exhibits 2.63 dB while the dual mode band-pass filter in the example exhibits 2.08 dB, and thus it is obvious that the insertion loss is greatly decreased in preferred embodiments of the present invention.

Figure 7:
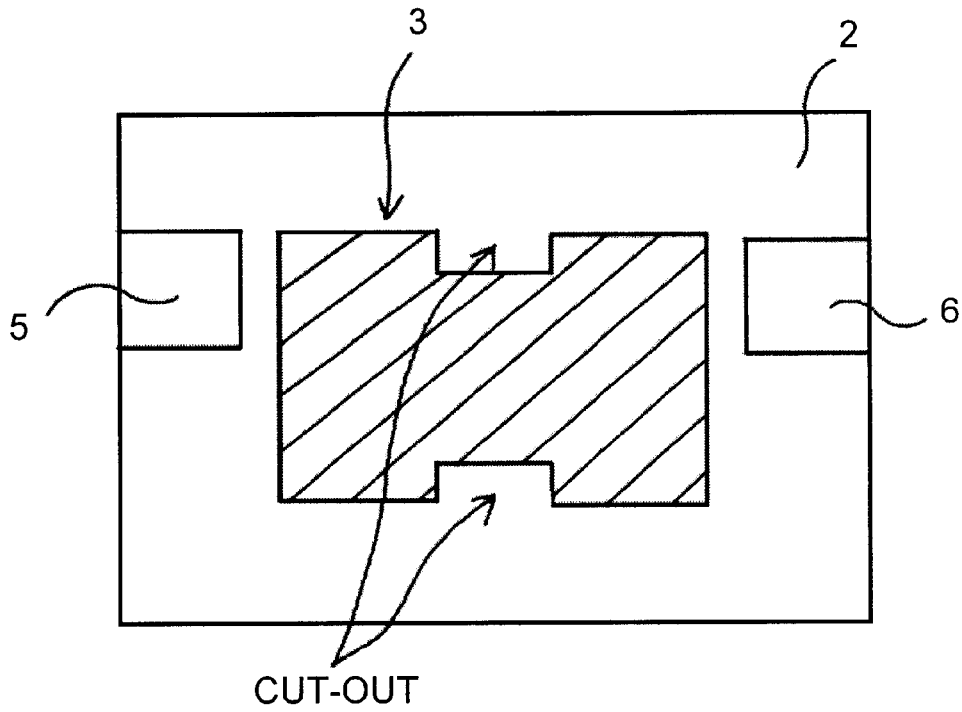
FIG. 7 is a schematic plan view of a resonator with a metal film with a cut-out.
Figure 8:
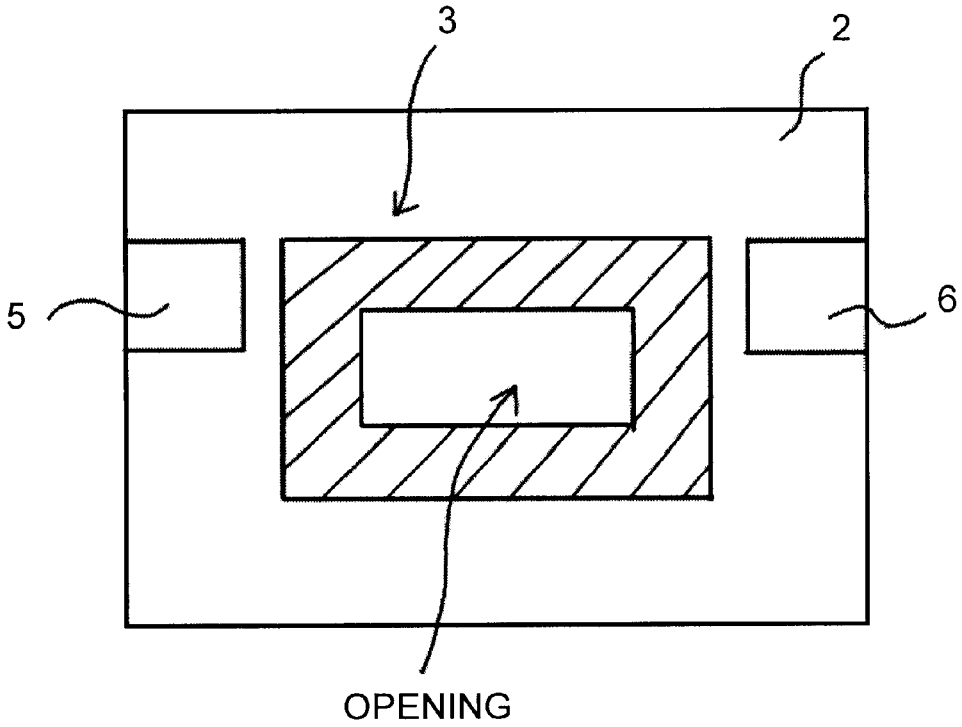
FIG. 8 is a schematic plan view of a resonator with a metal film with an opening.

Although the protrusions 3*e* and 3*f* are provided in order to combine two resonant modes in preferred embodiments described above, instead of the protrusions 3*e* and 3*f*, openings may be provided in the metal film 3 as shown in FIG. 8, or alternatively, cut-outs may be provided on the periphery of the metal film 3 as shown in FIG. 7. That is, by forming the protrusions 3*e* and 3*f*, openings, cut-outs, or other similar formations, so that the resonance electric field or the resonance current during the resonance of one of two resonant modes propagating in the shorter side direction and in the longer side direction of the substantially rectangular metal film 3 is controlled, the two resonant modes can be combined. Accordingly, in the dual mode band-pass filter in preferred embodiments of the present invention, the element for combining the two resonant modes is not particularly limited, and various ways, such as protrusions, openings, and cut-outs, may be used.

As described above, in preferred embodiments of the present invention, by using a dielectric ceramic containing a ceramic and a glass as main constituents, which are capable of being fired simultaneously with any one of Cu, Ag, and Au, and having a Q value of more than approximately 300 at about 10 GHz as the dielectric body, the insertion loss of the dual mode band-pass filter is effectively decreased. The dielectric ceramic will be described more specifically.

That is, by describing the specific examples with respect to the dielectric ceramic used in preferred embodiments of the present invention, it will be demonstrated that the dielectric ceramic has the Q value of approximately 300 or more at about 10 GHz or more.

As raw material powder, an $Mg(OH)_2$ powder and an $Al_2O_3$ powder were used, and both powders were weighed so that x and y satisfy the relationships $10 \leqq x \leqq 90$ and $10 \leqq y \leqq 90$, respectively, and $x+y=100$ when the sintered compact to be produced is represented by the formula $xMgO\text{-}yMgAl_2O_4$ in weight ratio composition. Wet mixing was performed for 16 hours, followed by drying. The dried mixture was calcined at 1,400° C. for 2 hours and then was pulverized.

Next, glass powder (sintering aid) having compositions shown in Table 1 below, approximately 20% to approximately 80% by weight of the raw material calcined as described above, and ZnO and CuO were formulated according to the ratios shown in Tables 2 and 3, an appropriate amount of binder was added thereto, and granulation was performed. Each of the mixtures under Nos. 1 to 52 in Tables 2 and 3 was molded at a pressure of 200 MPa to produce a columnar green compact with a diameter of about 12 mm and a thickness of about 7 mm.

The green compacts were fired in air at 900 to 1,000° C. for 2 hours, and the columnar insulating ceramics under Nos. 1 to 52 in Tables 2 and 3 were produced.

With respect to each of the thus-obtained columnar insulating ceramics, the relative dielectric constant $\in_r$ and the Q value at a resonant frequency of 10 GHz were measured by a dielectric resonator method (short-circuited at both ends of a dielectric resonator). Tables 2 and 3 show the results thereof.

With respect to each of the columnar insulating ceramics, the flexural strength was evaluated by the 3-point bending test according to JIS R1601. In the sample Nos. 2 to 7, 9 to 29, 39 to 40, and 42 to 52, the relative density was about 98% or more, and a high flexural strength of about 200 MPa was exhibited.

TABLE 1

| | $SiO_2$ (wt %) | $B_2O_3$ (wt %) | $Al_2O_3$ (wt %) | MgO (wt %) | BaO (wt %) | SrO (wt %) | CaO (wt %) | $Li_2O$ (wt %) |
|---|---|---|---|---|---|---|---|---|
| A | 22 | 43 | 8 | 22 | — | — | — | 2 |
| B | 20 | 41 | 6 | 28 | — | — | — | 3 |
| C | 13 | 60 | 10 | 12 | — | — | — | 5 |
| D | 50 | 25 | 3 | 17 | — | — | — | 5 |
| E | 45 | 3 | 20 | 25 | — | — | — | 7 |
| F | 42 | 13 | 5 | — | — | — | 40 | — |
| G | 12 | 60 | 10 | 13 | — | — | — | 5 |
| H | 51 | 25 | 3 | 16 | — | — | — | 5 |
| I | 13 | 61 | 10 | 11 | — | — | — | 5 |
| J | 45 | 3 | 21 | 25 | — | — | — | 6 |
| K | 33 | 33 | — | — | — | — | 24 | 10 |
| L | 45 | 2 | 20 | 25 | — | — | — | 8 |
| M | 35 | 36 | 20 | — | 5 | 4 | — | — |
| N | 19 | 40 | — | 22 | — | — | 19 | — |
| O | 23 | 52 | 6 | 17 | — | — | — | 2 |
| P | 33 | 33 | — | — | — | — | 23 | 11 |
| Q | 22 | 35 | 12 | 22 | — | — | — | 9 |

TABLE 2

| No. | MgO (wt %) | $MgAl_2O_4$ (wt %) | Glass Content (wt %) | Type | ZnO (wt %) | CuO (wt %) | Firing Temperature (° C.) | Relative Density (%) | ε | Q |
|---|---|---|---|---|---|---|---|---|---|---|
| 1 | 0 | 100 | 80 | A | 0 | 0 | 1,000 | 96 | 6.9 | 350 |
| 2 | 10 | 90 | 90 | A | 0 | 0 | 1,000 | 97 | 7.0 | 480 |
| 3 | 10 | 90 | 90 | A | 8 | 2 | 1,000 | 97 | 7.0 | 700 |
| 4 | 20 | 80 | 80 | A | 0 | 3 | 1,000 | 99 | 7.1 | 1,000 |
| 5 | 50 | 50 | 45 | A | 15 | 1 | 900 | 99 | 7.1 | 3,000 |
| 6 | 20 | 80 | 85 | A | 0 | 4 | 1,000 | 99 | 7.1 | 500 |
| 7 | 90 | 10 | 80 | A | 10 | 3 | 1,000 | 97 | 7.0 | 900 |
| 8 | 100 | 0 | 80 | A | 10 | 3 | 1,000 | 96 | 6.9 | 350 |
| 9 | 50 | 50 | 45 | B | 10 | 2 | 900 | 100 | 7.1 | 3,000 |
| 10 | 40 | 60 | 45 | B | 10 | 3 | 900 | 98 | 7.0 | 3,200 |
| 11 | 60 | 40 | 50 | B | 9 | 2 | 900 | 98 | 7.0 | 2,000 |
| 12 | 80 | 20 | 60 | B | 15 | 3 | 900 | 98 | 7.0 | 2,000 |
| 13 | 80 | 20 | 60 | B | 16 | 3 | 900 | 97 | 7.0 | 500 |
| 14 | 90 | 10 | 70 | B | 10 | 2 | 900 | 97 | 7.0 | 800 |
| 15 | 50 | 50 | 10 | B | 8 | 2 | 900 | 97 | 7.0 | 400 |
| 16 | 50 | 50 | 30 | C | 0 | 0 | 900 | 99 | 7.1 | 1,000 |
| 17 | 60 | 40 | 40 | C | 7 | 0 | 900 | 99 | 7.0 | 1,500 |
| 18 | 60 | 40 | 40 | C | 11 | 0 | 900 | 99 | 7.1 | 1,700 |
| 19 | 70 | 30 | 20 | C | 15 | 1 | 1,000 | 98 | 7.0 | 1,600 |
| 20 | 70 | 30 | 20 | C | 0 | 3 | 1,000 | 98 | 7.0 | 1,200 |
| 21 | 50 | 50 | 10 | C | 0 | 0 | 1,000 | 97 | 7.0 | 400 |
| 22 | 50 | 50 | 30 | D | 0 | 0 | 1,000 | 98 | 7.1 | 800 |
| 23 | 40 | 60 | 50 | D | 13 | 1 | 1,000 | 98 | 7.1 | 900 |
| 24 | 50 | 50 | 50 | E | 10 | 2 | 1,000 | 98 | 7.1 | 500 |
| 25 | 50 | 50 | 50 | F | 4 | 2 | 900 | 100 | 7.5 | 500 |
| 26 | 60 | 40 | 50 | F | 6 | 3 | 900 | 99 | 7.4 | 400 |
| 27 | 40 | 60 | 50 | F | 8 | 2 | 900 | 98 | 7.3 | 400 |
| 28 | 40 | 60 | 50 | F | 15 | 4 | 900 | 98 | 7.3 | 350 |
| 29 | 50 | 50 | 40 | F | 15 | 2 | 1,000 | 99 | 7.5 | 500 |
| 30 | 50 | 50 | 60 | G | 5 | 2 | 1,000 | 97 | 7.0 | 350 |
| 31 | 50 | 50 | 70 | G | 8 | 0 | 1,000 | 97 | 7.1 | 320 |

TABLE 3

| No. | MgO (wt %) | $MgAl_2O_4$ (wt %) | Glass Content (wt %) | Type | ZnO (wt %) | CuO (wt %) | Firing Temperature (° C.) | Relative Density (%) | ε | Q |
|---|---|---|---|---|---|---|---|---|---|---|
| 32 | 50 | 50 | 40 | G | 10 | 2 | 1,000 | 96 | 6.9 | 380 |
| 33 | 60 | 40 | 60 | H | 0 | 0 | 1,000 | 97 | 7.0 | 350 |
| 34 | 50 | 50 | 70 | H | 13 | 1 | 1,000 | 97 | 7.0 | 380 |
| 35 | 50 | 50 | 30 | I | 0 | 0 | 900 | 97 | 7.0 | 360 |
| 36 | 60 | 40 | 40 | I | 7 | 0 | 900 | 97 | 7.0 | 380 |
| 37 | 70 | 30 | 80 | I | 0 | 3 | 1,000 | 97 | 7.0 | 380 |
| 38 | 50 | 50 | 50 | J | 10 | 2 | 1,000 | 96 | 6.9 | 360 |
| 39 | 50 | 50 | 60 | K | 13 | 3 | 1,000 | 98 | 7.0 | 900 |
| 40 | 50 | 50 | 80 | K | 13 | 3 | 1,000 | 98 | 7.0 | 700 |
| 41 | 50 | 50 | 50 | L | 10 | 2 | 1,000 | 96 | 6.9 | 350 |
| 42 | 60 | 40 | 40 | M | 7 | 0 | 900 | 99 | 7.1 | 500 |
| 43 | 50 | 50 | 30 | M | 0 | 0 | 1,000 | 97 | 7.0 | 450 |
| 44 | 50 | 50 | 50 | N | 4 | 2 | 1,000 | 98 | 7.1 | 450 |
| 45 | 50 | 50 | 60 | O | 0 | 0 | 1,000 | 97 | 7.1 | 500 |
| 46 | 50 | 50 | 70 | O | 11 | 0 | 1,000 | 97 | 7.0 | 800 |
| 47 | 60 | 40 | 60 | O | 15 | 0 | 1,000 | 98 | 7.1 | 1,000 |
| 48 | 50 | 50 | 60 | P | 13 | 3 | 1,000 | 97 | 7.1 | 650 |
| 49 | 60 | 40 | 60 | P | 0 | 2 | 1,000 | 97 | 7.0 | 400 |
| 50 | 40 | 60 | 60 | P | 0 | 2 | 1,000 | 97 | 7.0 | 450 |
| 51 | 50 | 50 | 50 | Q | 0 | 3 | 1,000 | 97 | 7.0 | 500 |
| 52 | 50 | 50 | 50 | Q | 0 | 4 | 1,000 | 98 | 7.1 | 400 |

As is obvious from Tables 1 to 3, any one of dielectric ceramics under Sample Nos. 1 to 52 has a higher Q value at about 10 GHz in comparison with the BAS material, and the Q value exceeds approximately 300.

In particular, with respect to the dielectric ceramics under Sample Nos. 2 to 29, 39, 40, and 42 to 52, each including MgO—$MgAl_2O_4$-based ceramic powder and glass powder containing about 13% to about 50% by weight $SiO_2$, about 3% to about 60% by weight $B_2O_3$, and about 0% to about 20% by weight $Al_2O_3$, a higher Q value of about 400 or more is exhibited.

That is, in the dielectric ceramic containing the MgO—$MgAl_2O_4$-based ceramic powder and the glass powder containing silicon oxides, boron oxides, and aluminum oxides at the predetermined ratio described above, the Q value can be increased to about 400 or more, and thus it is possible to provide a dual mode band-pass filter in which the insertion loss is further decreased.

While preferred embodiments have been described above, it is to be understood that modifications and changes will be apparent to those skilled in the art without departing from the spirit of the invention. The scope of the present invention is therefore to be determined solely by the appended claims.

What is claimed is:

1. A dual mode band-pass filter comprising:

a dielectric body having first and second main surfaces;

a metal film partially disposed on the first main surface of the dielectric body or at a certain level in the dielectric body, the metal film having one of an opening, a protrusion, and a cut-out arranged to combine two resonant modes;

a ground electrode disposed on the second main surface or in the interior of the dielectric body so as to be opposed to the metal film via a portion of the dielectric body therebetween; and a pair of input-output coupling circuits being coupled with different portions of the metal film;

wherein the dielectric body includes a dielectric ceramic containing a ceramic and a glass as main constituents, and is capable of being fired simultaneously with any one of Cu, Ag, and Au, and having a Q value of more than approximately 300 at about 10 GHz;

wherein the dielectric body is made of a sintered material including a $MgO—MgAl_2O_4$-based ceramic powder and a glass powder containing about 13% to about 50% by weight $SiO_2$, about 3% to about 60% by weight $B_2O_3$, and about 0% to about 20% by weight $Al_2O_3$.

2. A dual mode band-pass filter according to claim 1, wherein the glass powder contains at least one alkaline-earth metal oxide selected from the group consisting of BaO, SrO, CaO, and MgO in an amount of about 10% to about 40% by weight of the total glass powder.

3. A dual mode band-pass filter according to claim 1, wherein the glass powder contains at least one alkali metal oxide selected from the group consisting of $Li_2O$, $K_2O$, and $Na_2O$ in an amount of about 10% by weight or less of the total glass powder.

4. A dual mode band-pass filter according to claim 1, wherein the dielectric body contains about 15% by weight or less ZnO.

5. A dual mode band-pass filter according to claim 1, wherein the dielectric body contains about 3% by weight or less CuO.

6. A dual mode band-pass filter according to claim 1, wherein the $MgO—MgAl_2O_4$-based ceramic powder is represented by the formula $xMgO\text{-}yMgAl_2O_4$, where x and y satisfy the relationships $10 \leqq x \leqq 90$ and $10 \leqq y \leqq 90$, respectively, and $x+y=100$.

7. A dual mode band-pass filter according to claim 1, wherein the weight ratio of the ceramic powder to the glass powder is approximately 20:80 to approximately 80:20.

8. A dual mode band-pass filter according to claim 1, wherein the dielectric body is substantially rectangular.

9. A dual mode band-pass filter according to claim 1, further comprising a plurality of protrusions disposed on longer sides of the metal film.

10. A dual mode band-pass filter according to claim 9, wherein the plurality of protrusions are arranged to combine two resonant modes.

11. A dual mode band-pass filter according to claim 1, wherein the input-output coupling circuits are arranged at shorter sides of the metal film.

12. A dual mode band-pass filter according to claim 1, further comprising capacitance-forming patterns capacitively coupled with the metal film.

13. A dual mode band-pass filter according to claim 1, wherein the dual mode band-pass filter has a triplate structure in which ground electrodes are disposed on and under the metal film with the dielectric body disposed therebetween.

14. A dual mode band-pass filter according to claim 1, wherein the metal film and the input-output coupling circuits are disposed on the upper surface of the dielectric body.

15. A dual mode band-pass filter according to claim 1, wherein the metal film has a shape that is one of substantially rectangular, substantially rhombic, substantially elliptic, substantially circular and substantially square.

16. A dual mode band-pass filter comprising:

a dielectric body having first and second main surfaces;

a metal film disposed on the first main surface of the dielectric body or at a certain level in the dielectric body, the metal film having one of at least a pair of openings, at least a pair of protrusions, and at least a pair of cut-outs arranged to combine two resonant modes;

a ground electrode arranged opposite to the metal film via a portion of the dielectric body therebetween; and a pair of input-output coupling circuits being coupled with different portions of the metal film;

wherein the dielectric body includes a dielectric ceramic containing a ceramic and a glass as main constituents, and is capable of being fired simultaneously with any one of Cu, Ag, and Au, and having a Q value of more than approximately 300 at about 10 GHz;

wherein the dielectric body is made of a sintered material including a $MgO—MgAl_2O_4$-based ceramic powder and a glass powder containing about 13% to about 50% by weight $SiO_2$, about 3% to about 60% by weight $B_2O_3$, and about 0% to about 20% by weight $Al_2O_3$.

17. A dual mode band-pass filter according to claim 16, wherein the glass powder contains at least one alkaline-earth metal oxide selected from the group consisting of BaO, SrO, CaO, and MgO in an amount of about 10% to about 40% by weight of the total glass powder.

18. A dual mode band-pass filter according to claim 16, wherein the glass powder contains at least one alkali metal oxide selected from the group consisting of $Li_2O$, $K_2O$, and $Na_2O$ in an amount of about 10% by weight or less of the total glass powder.

19. A dual mode band-pass filter according to claim 16, wherein the dielectric body contains about 15% by weight or less ZnO.

20. A dual mode band-pass filter according to claim 16, wherein the dielectric body contains about 3% by weight or less CuO.

21. A dual mode band-pass filter according to claim 16, wherein the $MgO—MgAl_2O_4$-based ceramic powder is represented by the formula $xMgO\text{-}yMgAl_2O_4$, where x and y satisfy the relationships $10 \leqq x \leqq 90$ and $10 \leqq y \leqq 90$, respectively, and $x+y=100$.

22. A dual mode band-pass filter according to claim 16, wherein the weight ratio of the ceramic powder to the glass powder is approximately 20:80 to approximately 80:20.

23. A dual mode band-pass filter according to claim 16, wherein the dielectric body is substantially rectangular.

24. A dual mode band-pass filter according to claim 16, wherein the dual mode band-pass filter has a triplate structure in which ground electrodes are disposed on and under the metal film with the dielectric body disposed therebetween.

25. A dual mode band-pass filter according to claim 16, wherein the metal film has a shape that is one of substantially rectangular, substantially rhombic, substantially elliptic, substantially circular and substantially square.

* * * * *